United States Patent [19]

Flett

[11] Patent Number: 4,478,003

[45] Date of Patent: Oct. 23, 1984

[54] INTERIOR INSULATING WINDOW SYSTEM

[76] Inventor: Dennis E. Flett, 1301 E. Silver Lake, Tucson, Ariz. 84713

[21] Appl. No.: 344,635

[22] Filed: Feb. 1, 1982

[51] Int. Cl.[3] ..... E05B 65/03

[52] U.S. Cl. ..... 49/63; 49/501; 49/485; 49/404

[58] Field of Search ..... 49/501, 404, 420, 425, 49/485, 63

[56] References Cited

U.S. PATENT DOCUMENTS

| | | | |
|---|---|---|---|
| 3,117,657 | 1/1964 | Bruno | 49/425 |
| 3,411,239 | 11/1968 | Grossman | 49/425 X |
| 3,600,857 | 8/1971 | La Barge et al. | 49/404 |

*Primary Examiner*—Kenneth Downey

*Attorney, Agent, or Firm*—Weiss and Holloway

[57] ABSTRACT

The first and second vertical member of a storm window frame each include channels and vinyl sleeves for holding a double strength glass pane in position. One of the vertical members includes weather-stripping which protrudes from the frame in an exterior direction while the other vertical member includes weather-stripping which protrudes from the frame in an interior direction. In use, two or more of such panes are slidably mounted adjacent each other in thermal plastic tracks. The weather-stripping at the extreme ends of the window assembly create a seal between a window assembly and the track. The weather-stripping at overlapping portions of panes abutt against each other when the window is closed to create a seal thus permitting the creation of a still air space between an existing window and the storm window assembly.

2 Claims, 8 Drawing Figures

INTERIOR INSULATING WINDOW SYSTEM

BACKGROUND OF THE INVENTION

1. Field of the Invention

This invention relates generally to windows and, more particularly, to a storm window assembly creating an insulating air space between itself and an existing window.

2. Description of the Prior Art

Storm windows have been used for many years in geographic areas having colder climates to reduce heating costs. Furthermore, in areas such as the southwest, both the chill of winter and the heat of summer can be kept out by means of storm windows. Such windows work as follows:

Normally, a window contains a single pane of glass. If it were assumed that the outside temperature against that single pane of glass were 98° on a summer day, the interior cooling system would have to work extremely hard to maintain a comfortable 75° within the structure. A 30–50 percent energy loss may be attributed to non-insulated windows and doors resulting in extremely high cooling costs each month. The problems stem from the fact that glass is an extremly poor insulator.

SUMMARY OF THE INVENTION

It is an object of the present invention to provide an improved storm window assembly.

It is a further object of the present invention to provide an improved storm window assembly which causes an insulating air space to be formed between the storm window and the existing window.

It is a still further object of the invention to provide an improved storm window assembly wherein the windows are positioned in thermal plastic tracks which are secured to existing window frame by double sided foam tape.

According to a broad aspect of the invention, there is provided a storm window comprising a pane of glass, a frame around said pane of glass having first and second vertical members, said first member being equipped with weather-stripping which protrudes in an exterior direction and said second member being equipped with weather-stripping which protrudes in an interior direction.

According to another aspect of this invention, there is provided a storm window assembly comprised of at least two individual overlapping windows which ride in a U-shaped track having sidewalls, each of said windows comprising a pane of glass, and a frame around said pane of glass having first and second vertical members, said first vertical member equipped with weather-stripping which engages one of said sidewalls, and said second vertical member equipped with weather-stripping in a vertical member of an overlapping window pane to create a seal.

According to a still further aspect of the invention there is provided a track for mounting on a window sill into which a window may be slidably positioned comprising, a base, at least first and second walls extending perpendicularly from said base to form at least one channel, a plurality of longitudinal ridges on the underside of said base, and a layer of adhesive material coupled to the underside of said base over said ridges for securing said track to said sill.

The above and other objects, features and advantages of the present invention will be more clearly understood from the following detailed description taken in conjunction with the accompanying drawings, in which:

THE SPECIFICATION

Figure 1:
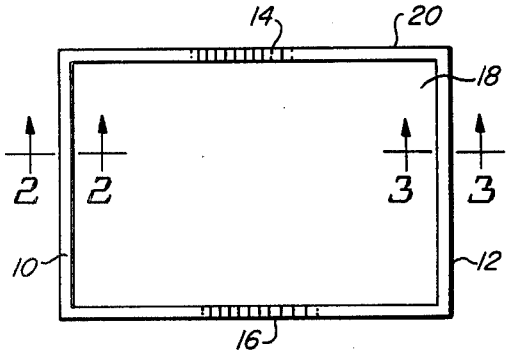
FIG. 1 is a plan view of a single storm window according to the present invention.

FIG. 1 illustrates a single panel of a storm window manufactured in accordance with the present invention. The panel consists of a frame of double strength glass 18 enclosed in a frame which includes first and second vertical members 10 and 12, respectively, and first and second horizontal members 14 and 16, respectively. The frame is preferably made of anodized aluminum.

Figure 2:
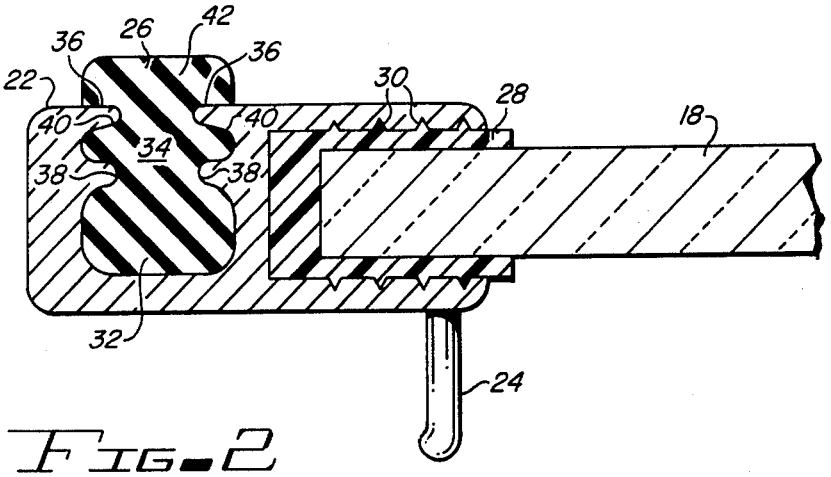
FIG. 2 is a cross-sectional view of one of the vertical frame members shown in FIG. 1 and taken along line 2—2.

FIG. 2 is a cross-sectional view of the frame taken along line 2—2 of FIG. 1. As can be seen, the frame 22 has a generally rectangular cross-section to which a handle 24 is coupled or is formed integrally therewith. The frame contains a first recess which houses ⅛ inch weather-stripping 26 and a second recess into which a vinyl sleeve 28 is positioned for holding the double strength glass pane 18. The frame is provided with a plurality of notches 30 which assists in securing the vinyl sleeve 28. The opening into which the vinyl sleeve is placed may be approximately 0.25 inches while the overall width of the frame is approximately 0.35 inches exluding the handle. The wider dimension of the frame may be approximately 0.77 inches and the handle length may be approximately 0.25 inches.

The opening into which the ⅛ inch weather-stripping 26 is inserted consists of a generally rounded region 32 and a neck portion 34. Neck portion 34 is comprised of first and second opposed projections 36 having a curved radius of approximately 0.15 inches, third and fourth proposed projections 38 having a curved radius of approximately 0.02 inches and first and second recessed areas 40 having a concave surface of radium 0.2 inches. Weather-stripping 26 is referred to as ⅛ inch weather-stripping because it comprises a protrusion 42 which extends ⅛ inch beyond the surface of the frame.

Figure 3:
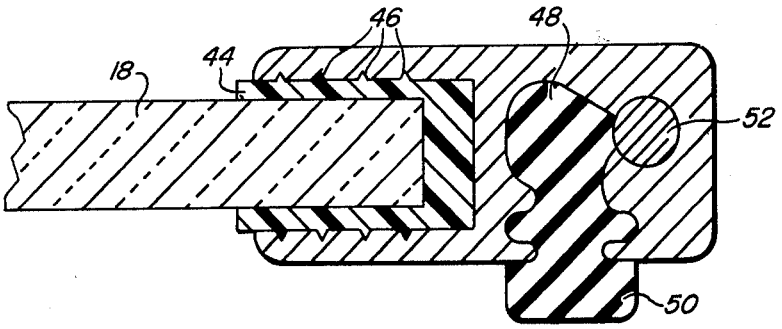
FIG. 3 is a cross-sectional view of a second vertical frame member shown in FIG. 1 and taken along line 3—3.

FIG. 3 is a cross-sectional view of the frame and window taken along line 3—3 of FIG. 1. As can be seen, the pane of double strength glass 18 is secured within a vinyl sleeve 44 held by notches 46 as was the case in FIG. 2. The weather-stripping 48 in this case is ¼ inch weather-stripping; i.e. a protrusion 50 extends ¼ inch beyond the surface of the frame. Since the dimensions are similar to those given in connection with FIG. 2, they need not be repeated. The cross-sectional view shown in FIG. 3 also illustrates a number 5 screw 52 adjacent weather-stripping 48.

Figure 4:
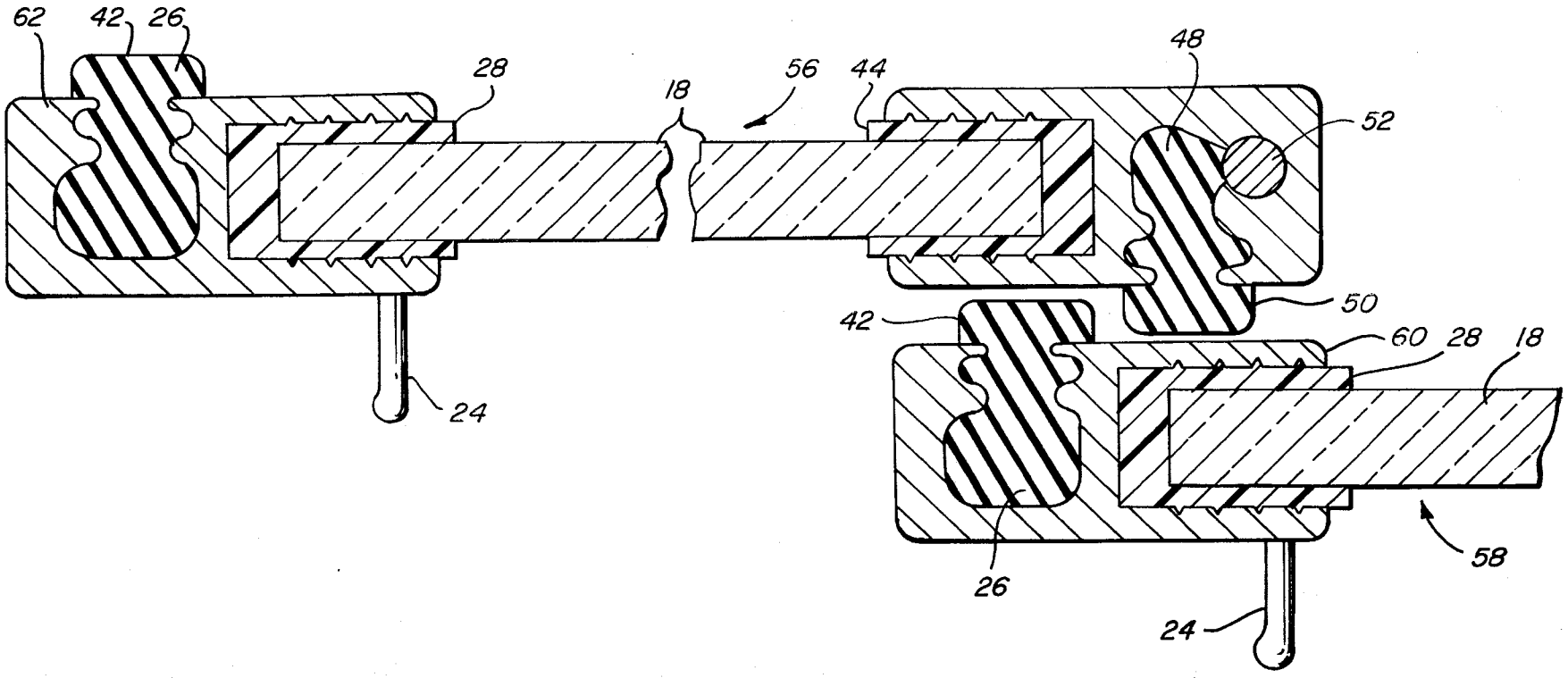
FIG. 4 is a cross-sectional view illustrating how two windows of the type shown in FIG. 1 cooperate with each other which would be located within a frame to form a still air space between the storm window and an existing window.

FIG. 4 illustrates how two windows of the type shown in FIGS. 1, 2 and 3 may be utilized to create a still air space between itself and the existing window. Two windows are shown generally at 56 and 58. Of course, the window frame opening is premeasured and the window panels customized to fit prior to their insertion into the window frame. That area above window panel 56 corresponds to the space between panels 56 and 58 and the existing window and is referred to as the still air space. That area below panels 56 and 58 are interior to the storm window. Like elements are denoted with like reference numerals.

Figure 5:
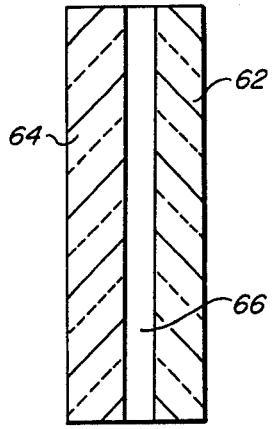
FIG. 5 further illustrates the still air space between the existing window and the storm window.

As should be apparent, handles 24 will permit either panel 56 or 58 to slide in either direction. The ⅛ inch weather stripping 42 in panel 56 will always maintain a seal between the frame and the running portion of the track or, when the window is closed, the vertical position of the track. When the window is closed, the ¼ inch weather-stripping 50 will abutt against ⅛ inch weather-stripping 42 to seal the still air space thus permitting it to function as an insulator as is shown more specifically in FIG. 5. That is, the existing window 62 will be separated from the storm window 64 by a still air space 66. This will permit the existing window to assume a temperature near the external outside temperature and the insulating or storm window to assume a desired interior temperature. The still air space substantially reduces losses therebetween.

Figure 6:
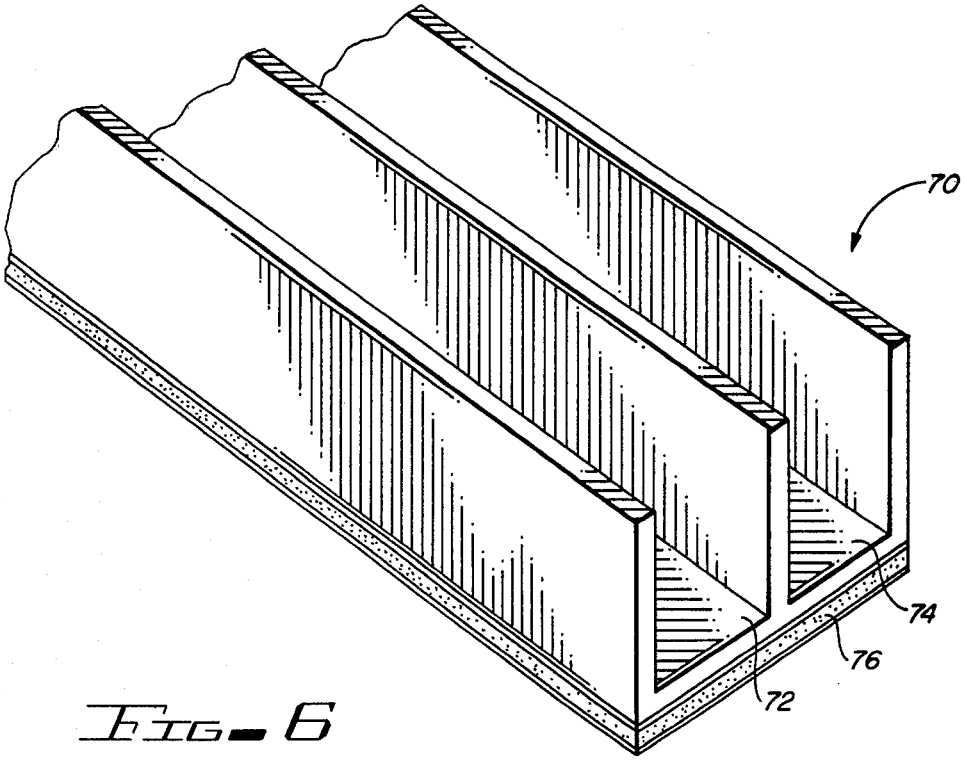
FIG. 6 is an isometric view of a track utilized for positioning the windows in accordance with the present invention.

FIG. 6 is an isometric view of a track 70 into which the windows described above may be positioned for sliding movement therein. The track is made of a non-conductive thermal plastic material and comprises first and second channels 72 and 74 respectively. The track is secured by means of a double sided foam tape 76. When the protective paper is removed from the tape, the track may be applied to the surface of the existing sill thus providing a seal completely around the perimeter.

Figure 7:
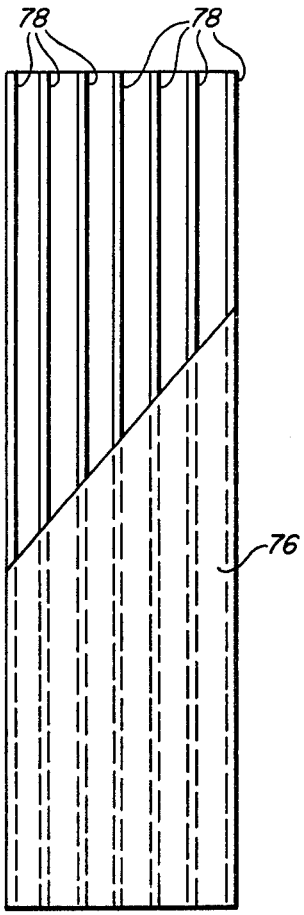
FIG. 7 is an underside view of the track shown in FIG. 6.

FIG. 7 illustrates the underside of track 70 with a portion of tape 76 removed. As can be seen, the underside of the track is equipped with a plurality of longitudinal ridges 78. The foam tape deforms to accomodate these ridges making air infiltration almost impossible thus creating an even tighter seal.

The above description is given by way of example only. Changes in form and details may be made by one skilled in the art without departing from the scope of the invention as defined by the appending claims.

Figure 8:
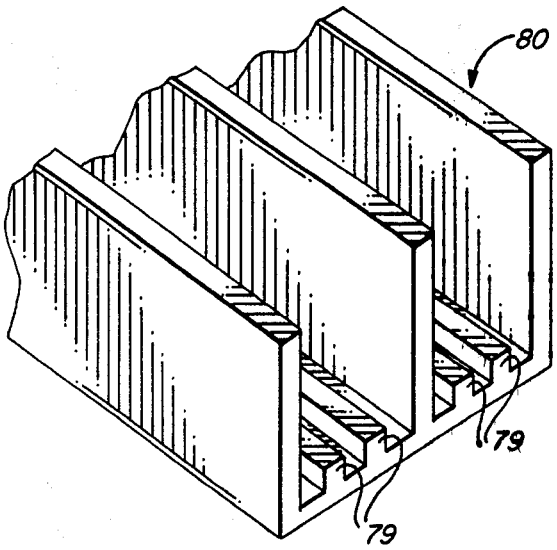
FIG. 8 is an isometric view of a track illustrating elevated guides which provide smooth and even window operation.

FIG. 8 is an isometric view of Base track 80 in which the track is provided with elevated guides 79 that allow smooth and even operation of the window therein.

What is claimed is:

1. A storm window assembly comprising:

a U-shaped track for mounting on a window sill into which a window may be slidably positioned including a base, at least first and second sidewalls extending perpendicularly from said base to form at least one channel, and a layer of adhesive material coupled to the underside of said base for securing said track to said window sill; and at least two individual overlapping windows which ride in said U-shaped track, each of said overlapping windows including:

a pane of glass, a frame around said pane of glass including first and second vertical members, each of said vertical members having a notched channel into which said pane of glass is positioned, said first vertical member having weather-stripping means extending the vertical height of said first vertical member for operably engaging one of said track sidewalls, said second vertical member having weather-stripping means extending the vertical height of said second vertical member for operably engaging the weather-stripping means in a confronting vertical member of the overlapping window to create a seal between said overlapping windows when in the closed position, each of said weather-stripping means which engages the other of said weather-stripping means to create said seal being positioned on the side of its respective overlapping window that is closest to the other overlapping window, one of said first and second vertical members being equipped with handle means for opening and closing said window assembly, and sleeve means positioned between said notched channel and said pane of glass for operably securing said pane, the notches in said notched channel securely positioning said sleeve means therein.

2. A storm window assembly according to claim 1 wherein each of said frames is made of anodized aluminum and said sleeve means is made of vinyl.

* * * * *

UNITED STATES PATENT AND TRADEMARK OFFICE

CERTIFICATE OF CORRECTION

PATENT NO. : 4,478,003

DATED : October 23, 1984

INVENTOR(S) : Dennis E. Flett, et al.

It is certified that error appears in the above-identified patent and that said Letters Patent are hereby corrected as shown below:

On the title page;

To the designation of inventors, the following name should be added:

Gregory Donovan, 5671 - 35th Street, Tucson, Arizona 85711

The designation of inventors above the Title should be amended to read: Flett et al.

Signed and Sealed this

*Thirteenth* Day of *August 1985*

[SEAL]

*Attest:*

DONALD J. QUIGG

*Attesting Officer* *Acting Commissioner of Patents and Trademarks*